US010035271B2

(12) United States Patent
Kao

(10) Patent No.: US 10,035,271 B2
(45) Date of Patent: Jul. 31, 2018

(54) FOLDING KNIFE HAVING LOCKING FUNCTION

(71) Applicant: Chih-Chen Kao, Taoyuan (TW)

(72) Inventor: Chih-Chen Kao, Taoyuan (TW)

( * ) Notice: Subject to any disclaimer, the term of this patent is extended or adjusted under 35 U.S.C. 154(b) by 0 days.

(21) Appl. No.: 15/385,986

(22) Filed: Dec. 21, 2016

(65) Prior Publication Data

US 2018/0133907 A1 May 17, 2018

(30) Foreign Application Priority Data

Nov. 11, 2016 (TW) ..... 105217245 U

(51) Int. Cl.
*B26B 1/04* (2006.01)

(52) U.S. Cl.
CPC ..... *B26B 1/042* (2013.01)

(58) Field of Classification Search
CPC ..... B26B 1/042
USPC ..... 30/159, 160, 161
See application file for complete search history.

(56) References Cited

U.S. PATENT DOCUMENTS 4,347,665 A * 9/1982 Glesser ..... B26B 1/042 30/161
5,647,129 A * 7/1997 Stamper ..... B26B 1/042 30/139
6,732,436 B2 * 5/2004 Moizis ..... B26B 1/044 30/155
6,810,588 B1 * 11/2004 Cheng ..... B26B 1/046 30/153
6,918,184 B2 * 7/2005 Glesser ..... B26B 1/04 30/161
7,165,329 B2 * 1/2007 Kao ..... B26B 1/044 30/160
7,458,159 B2 * 12/2008 Galyean ..... B26B 1/04 30/159
7,694,421 B2 * 4/2010 Lin ..... B26B 1/046 30/159
7,886,444 B2 * 2/2011 Kao ..... B26B 1/044 30/159
8,161,653 B2 * 4/2012 Nenadic ..... B26B 1/04 30/155
8,813,366 B2 * 8/2014 Chen ..... B26B 1/048 30/158
9,302,399 B2 * 4/2016 Kao ..... B26B 1/044
9,579,807 B2 * 2/2017 Chu ..... B26B 1/04
9,751,222 B2 * 9/2017 Kao ..... B26B 1/042
(Continued)

*Primary Examiner* — Hwei C Payer
(74) *Attorney, Agent, or Firm* — Bacon & Thomas, PLLC

(57) ABSTRACT

The present invention is to provide a folding knife with a locking function comprising a handle, a blade pivotally connected to an end of handle through a pivot pin, a poke member and a first elastic component; wherein blade includes a locking pin protruded adjacent to pivot pin; e poke member includes a poke part at an end thereof and exposed out of handle. The other end of poke member is pivotally connected between pivot pin and the other end of handle. Poke member includes a locking slot recessed adjacent to a middle section thereof and facing pivot pin. first elastic component includes an end abutted against the middle section, and the other end fixed between poke member and the other end of handle, for applying an elastic force on poke member, so as to ensure locking pin to be engaged into locking slot, when blade is received inside handle.

20 Claims, 7 Drawing Sheets

(56) References Cited

U.S. PATENT DOCUMENTS

| | | | | |
|---|---|---|---|---|
| 2005/0172497 | A1* | 8/2005 | Linn | B26B 1/02 30/161 |
| 2006/0168819 | A1* | 8/2006 | Perreault | B26B 1/044 30/161 |
| 2008/0276462 | A1* | 11/2008 | Kao | B26B 1/044 30/155 |
| 2013/0067750 | A1* | 3/2013 | Kao | B26B 1/02 30/159 |

* cited by examiner

FOLDING KNIFE HAVING LOCKING FUNCTION

FIELD OF THE INVENTION

The present disclosure relates to a folding knife. More particularly to a folding knife having a locking function to stably position its blade, thereby improving safety for a user in carry or use.

BACKGROUND OF THE INVENTION

A commercially available folding knife includes a handle and a blade body which are pivotally connected with each other. The blade body is rotatable about its pivoting location to be out of the handle or received into the handle. After the folding knife is folded, it has a smaller size to facilitate the user to carry and it is also safer for the user to carry because the blade body is received into the handle. Therefore, compared with other non-foldable knife, the folding knife has better convenience and is more suitable for divers, outdoorsmen, or Military and police personnel.

Generally, in order to improve convenience of operating the folding knife, manufacturers develop an auxiliary tool which includes an elastic sheet to push the blade body. Please refer to FIGS. 1A and 1B. The folding knife 1 includes a blade body 11, a handle 13 and an elastic sheet 15. An end of the blade body 11 is pivotally connected to an end of the handle 13, and the blade body 11 is rotatable about its pivoting location, so that the other end of the blade body 11 (that is, a tip) can be exposed out of the handle 13 or received into the handle 13. The blade body 11 includes a push pin 111 disposed adjacent to the end thereof and out of the handle 13, and the user can push the push pin 111 by finger. The elastic sheet 15 has an end located adjacent to a position where the handle 13 and the blade body 11 are pivotally connected with each other, and other end extended towards the other end of the handle 13 and located adjacent to the other end of the handle 13. Please refer back to FIG. 1A. When the blade body 11 is completely received into the handle 13, the elastic sheet 15 is abutted with the end of the blade body 11 to apply a first force L1 on the blade body 11, as shown by a dashed arrow L1 of FIG. 1A. While being applied by the force L1, the blade body 11 can be rotated to the handle 13, thereby more tightly positioning the blade body 11 into the handle 13. Please refer back to FIG. 1B. When the blade body 11 is forced to rotate out of the handle 13 by a predetermined angle (about 4 to 8 degrees), the elastic sheet 15 may apply a second force L2 on the blade body 11, as shown by a dashed arrow L2 of FIG. 1B. Subject to the second force L2, the blade body 11 is rotated out of the handle 13, thereby completely rotating the blade body 11 out of the handle 13 instantly. When wanting to push the blade body 11 received in the handle 13 to rotate out of the handle 13, the user just pushes the push pin 111 by thumb to rotate the blade body 11 out of the handle 13 by a predetermined angle (about 4 to 8 degrees), so that the blade body 11 can instantly be rotated out of the handle 13, similar to a conventional spring knife.

Furthermore, some manufacturers replace the elastic sheet by a volute spring, to be the auxiliary tool for pushing the blade body. The folding knife described below includes some elements the same as that of the conventional knife, so these elements shown in FIG. 2 are labeled by the reference numbers the same as that of FIG. 1A. Please refer to FIG. 2. A volute spring 21 is assembled at a position where the blade body 11 and the handle 13 are pivoted with each other. The volute spring 21 always applies a force on the blade body 11 to rotate the blade body 11 out of the handle 13. When the blade body 11 is completely received into the handle 13, a constraining unit (not shown in FIG. 2) on the handle 13 can constrain the blade body 11 and apply other force on the blade body 11, thereby positioning the blade body 11 in the handle 13. As a result, when wanting to rotate the blade body 11 received in the handle 13 out of the handle 13, the user just pushes the push pin 111 on the blade body 11 to overcome the other force applied by the constraining unit, thereby releasing the blade body 11 from being constrained by the constraining unit. At this time, subject to the force applied by the volute spring 21, the blade body 11 is quickly rotated out of the handle 13.

The conventional folding knife may be easy to use, but if its blade body is unable to hold in a complete unfolded state or a completely received state reliably, it may cause safety problem. For this reason, the knife manufacturers design various lock mechanisms, such as liner lock mechanism, frame lock mechanism, back lock mechanism or axis lock mechanism, in order to improve safety of the folding knife. To summarize, safety of the folding knife in use is always a topic attracting people's attention, and what is need is to develop a new folding knife having better safety, a concise structure, and more convenience in use.

SUMMARY OF THE INVENTION

In order to solve the conventional technology problem, the inventors make effort in developing a folding knife having a locking function according to long term study and experiments.

An objective of the present disclosure is to provide a folding knife with a locking function, comprising: a handle, a blade body, a poke member and a first elastic component. The blade body includes a blade at a side thereof, a blade back at other side thereof, a tip formed at an end thereof and a part adjacent to other end thereof and pivotally connected a part of the handle adjacent to an end of the handle through a pivot pin, so that the blade body is rotatable to be completely received into a side of the handle or unfolded out of the handle. The blade body includes a locking pin protruded adjacent to the pivot pin. The poke member includes a poke part disposed at an end thereof and exposed out of the other side of the handle. The other end of the poke member is pivotally connected between the pivot pin and the other end of the handle. The poke member includes a locking slot recessed adjacent to a middle section thereof and facing the pivot pin. Furthermore, the first elastic component includes an end abutted with a part of the poke member adjacent to a middle section of the poke member, and other end fixed between the poke member and the other end of the handle in the handle, and configured to apply a first elastic force on the part of the poke member adjacent to the middle section of the poke member, so that the poke part is abutted with the other side of the handle. When the blade is received into the side of the handle, the locking pin is engaged into the locking slot, so that the blade body becomes non-rotatable relative to the handle and is in a locked state. When the poke part is poked towards the other end of the handle, the locking pin is released from the locking slot, so that the blade body becomes rotatable relative to the handle and is in a released state. Therefore, after the blade body is received into the handle, the poke member automatically makes the blade body in the locked state, thereby greatly improving safety in carry.

Other objective of the present disclosure is that the folding knife further includes a second elastic component which is configured to apply a second elastic force on the blade body to automatically eject and unfold the blade body and its blade out of the handle. Therefore, when the blade body is in the released state, the user can rotate out the blade body easily to operate the folding knife quickly.

Other objective of the present disclosure is that the blade body includes a locating groove recessed adjacent to the pivot pin and facing the blade, and the poke member includes a locating pin disposed adjacent to a middle section thereof, and the locating pin is engaged into the locating groove when the blade is received into the side of the handle. When the poke part is poked towards the other end of the handle, the locating pin is separated from the locating groove and, at this time, the locating pin pushes an inner side of the locating groove to push the blade body slightly out of the handle.

Another objective of the present disclosure is that the poke member includes a locking arm protruded between the poke part and the locking groove and towards the pivot pin, and a free end of the locking arm is engaged into the locking pin when the blade is unfolded out of the side of the handle, so that the blade body is in the locked state and unable to rotate relative to the handle. The free end of the locking arm is separated from the locking pin when the poke part is poked towards the other end of the handle, so that the blade body is in the released state and able to rotate relative to the handle. Therefore, when the folding knife is in use, it can ensure that the blade body can be positioned at current position reliably, thereby greatly improving safety of the folding knife in use.

BRIEF DESCRIPTION OF THE DRAWINGS

The structure, operating principle and effects of the present disclosure will be described in detail by way of various embodiments which are illustrated in the accompanying drawings.

DETAILED DESCRIPTION OF THE PREFERRED EMBODIMENTS

Figure 1A:
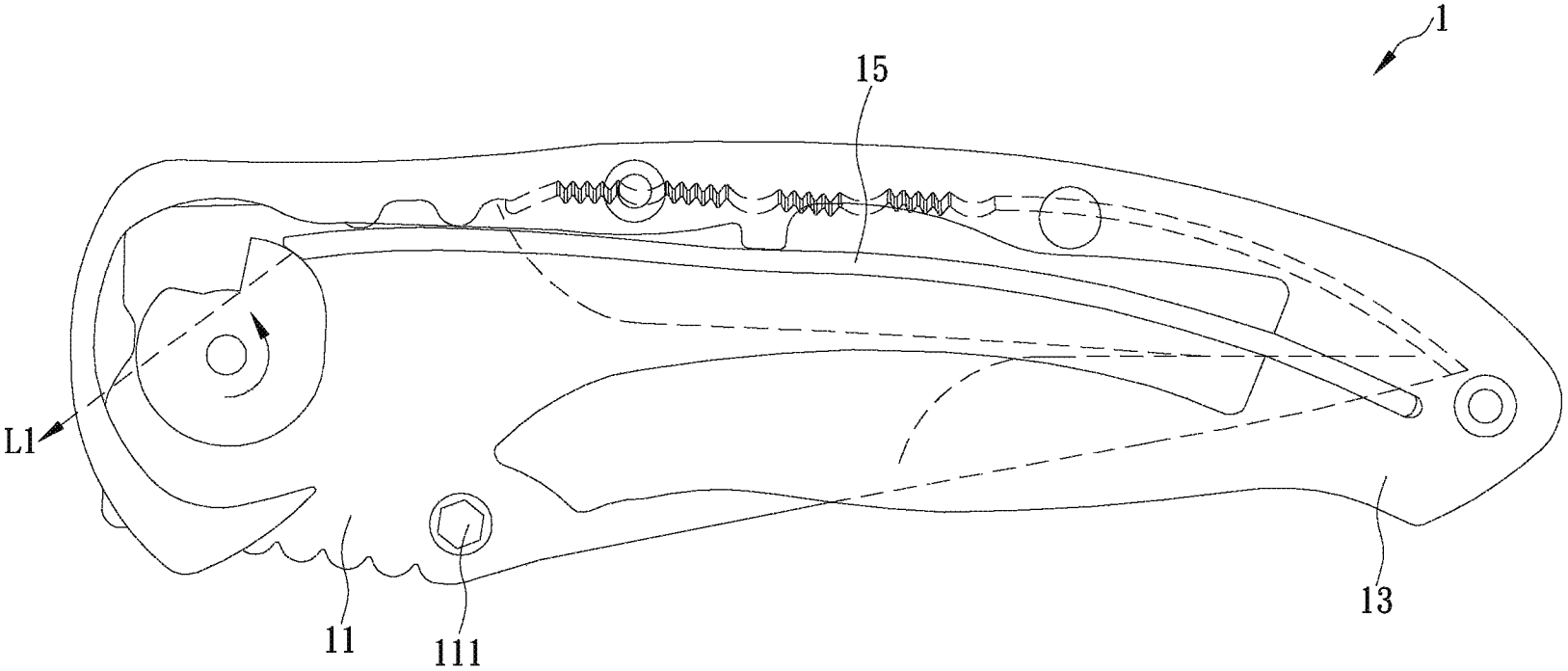
FIG. 1A(Prior Art)
FIG. 1A is a schematic view of a conventional folding knife in a folded state.
Figure 1B:
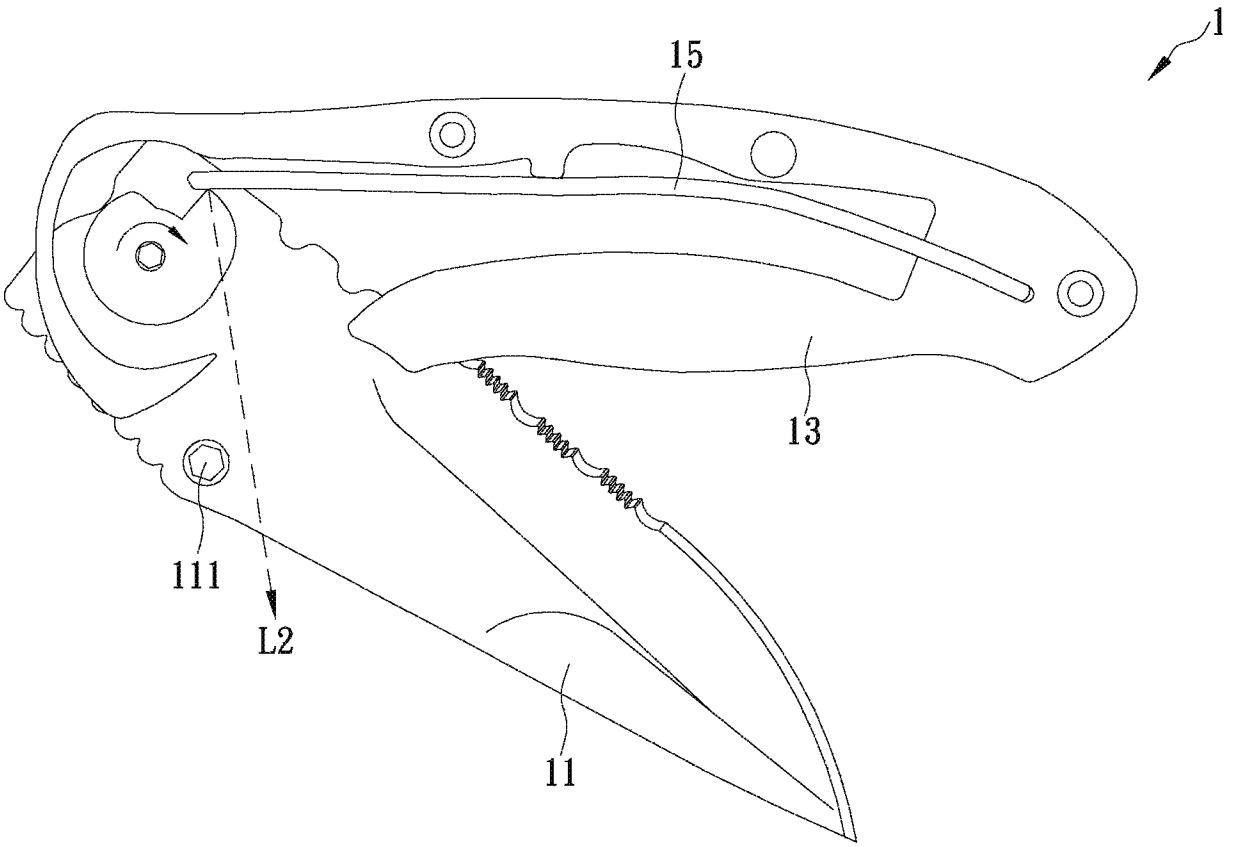
FIG. 1B(Prior Art)
FIG. 1B is a schematic view of the conventional folding knife being unfolded non-completely.
Figure 2:
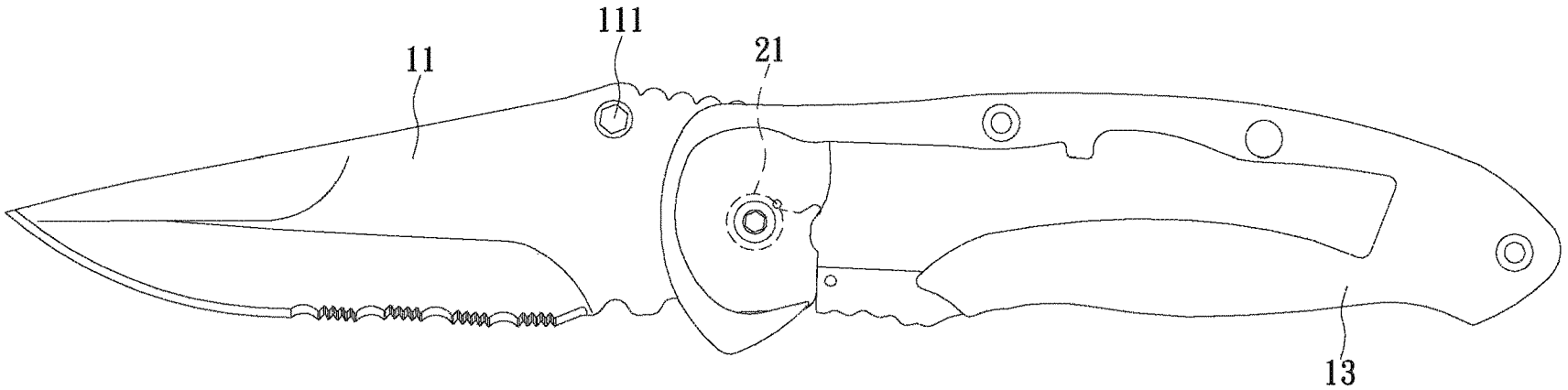
FIG. 2(Prior Art)
FIG. 2 is a schematic view of another conventional folding knife in an unfolded state.

The following embodiments of the present invention are herein described in detail with reference to the accompanying drawings. These drawings show specific examples of the embodiments of the present invention. It is to be understood that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be understood that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present invention. As used herein, the term "or" includes any and all combinations of one or more of the associated listed items.

Figure 3:
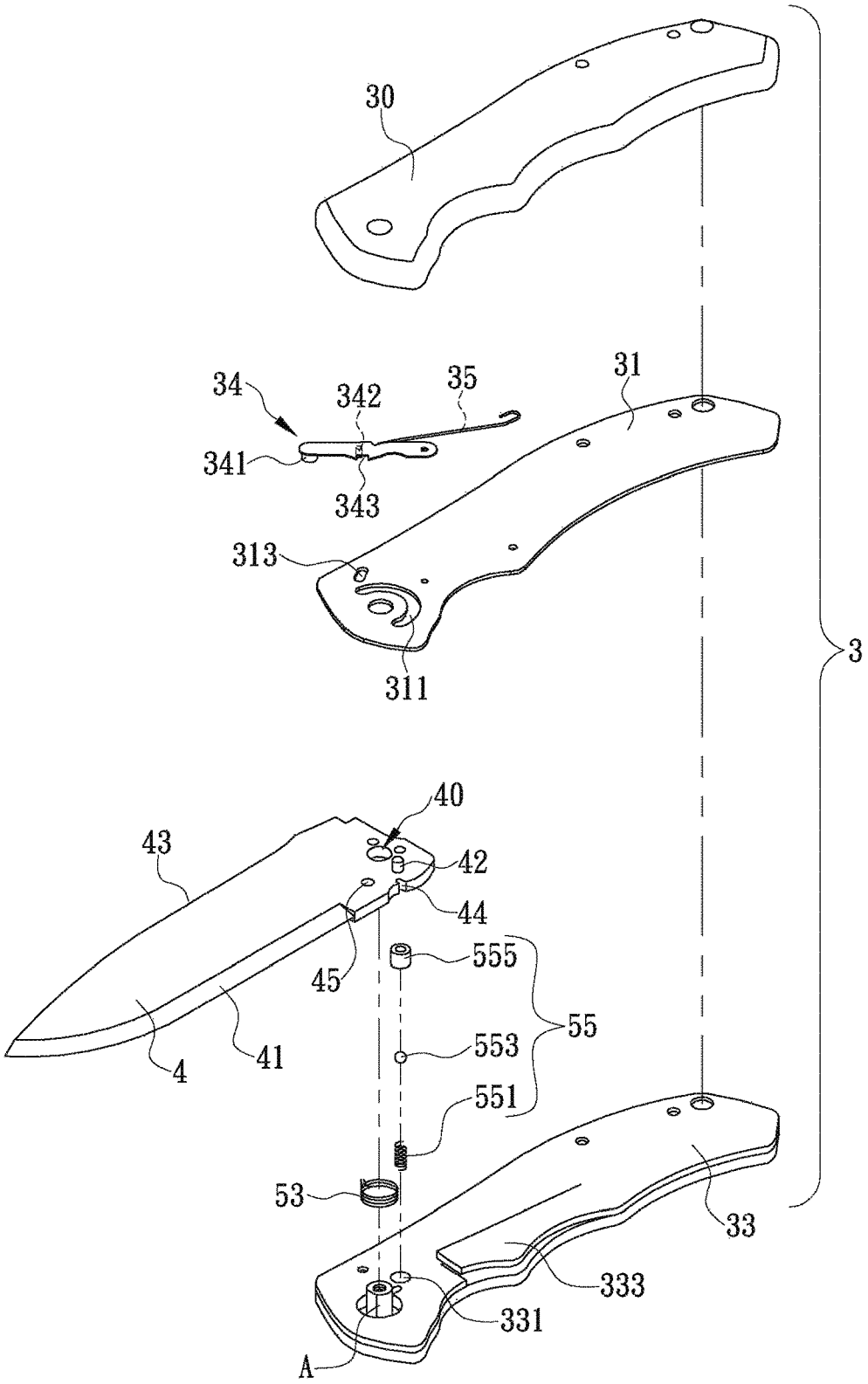
FIG. 3 is an exploded diagram of a folding knife of the present disclosure.

The present disclosure illustrates a folding knife with a locking function. Please refer to FIG. 3, which illustrates an embodiment of the folding knife of the present disclosure. The folding knife includes a handle 3, a blade body 4, a poke member 34 and a first elastic component 35. It should be noted that aforesaid elements are necessary elements for realizing the function of the embodiment of the folding knife of the present disclosure, however, upon practical demand, manufacturers can add other elements to make the folding knife appear aesthetically appealing and fashionable, and make the folding knife more stable; or, the manufacturers can change shapes and structures of the handle 3, blade body 4 or other members, without being limited by the pattern shown in the figures of the present disclosure. As shown in FIG. 3, the handle 3 includes multiple elements, such as a first outer plate 30, a middle plate 31 and a second outer plate 33. In order to reduce complexity of the drawings for easy understanding, FIGS. 4A through 5 do not show other elements of the folding knife and only show the pattern of the handle 3 (that is, the middle plate 31); however, one skilled in the art is able to effortlessly add detailed features of the handle 3 on the corresponding elements (such as the first outer plate 30, the middle plate 31 and the second outer plate 33) of the embodiment after understanding entire technical features of the present disclosure. The way of connecting the plates 30, 31 and 33 can be implemented by a locking manner, an engaging manner, an adhering manner or the like. It should be noted that any connecting manner which can be used to combine the plates 30, 31 and 33 to form the handle 3 is covered in a scope of the present disclosure.

Figure 4A:
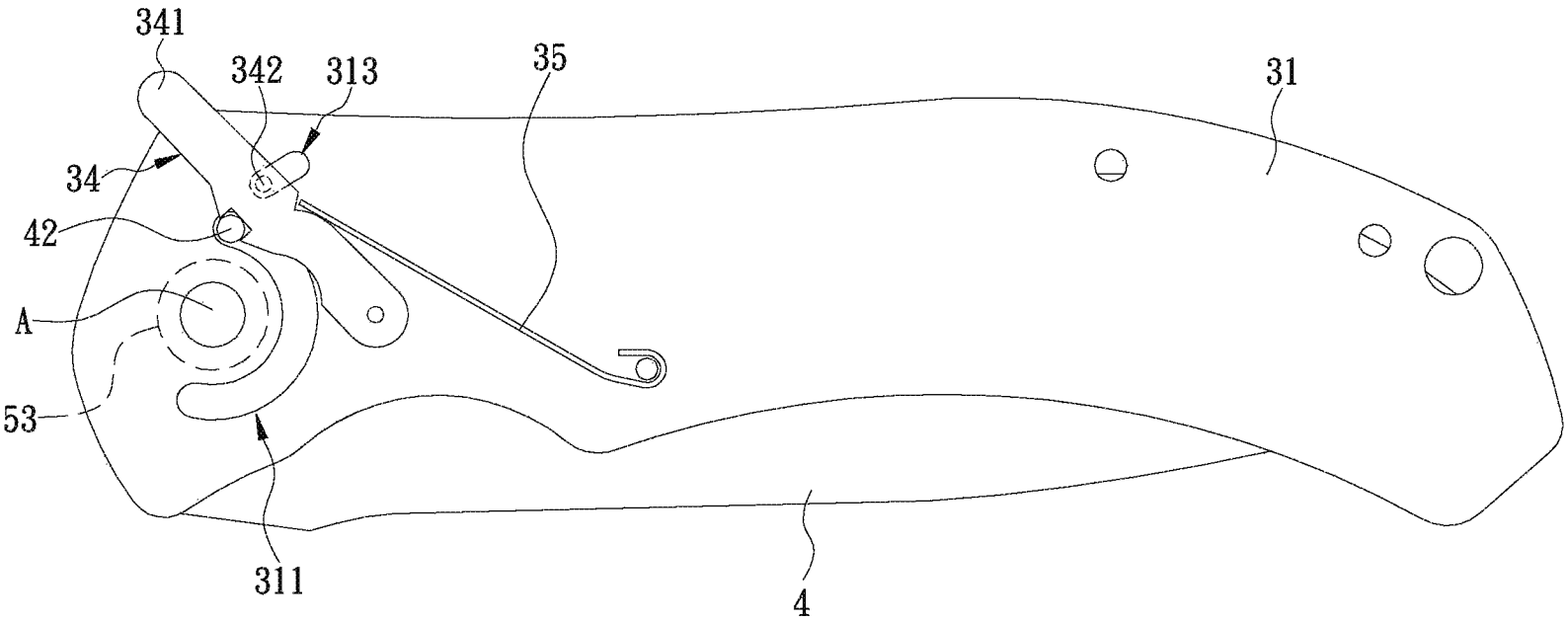
FIG. 4A is a schematic view of a first state of the folding knife of the present disclosure, illustrating that the folding knife is folded.
Figure 5:
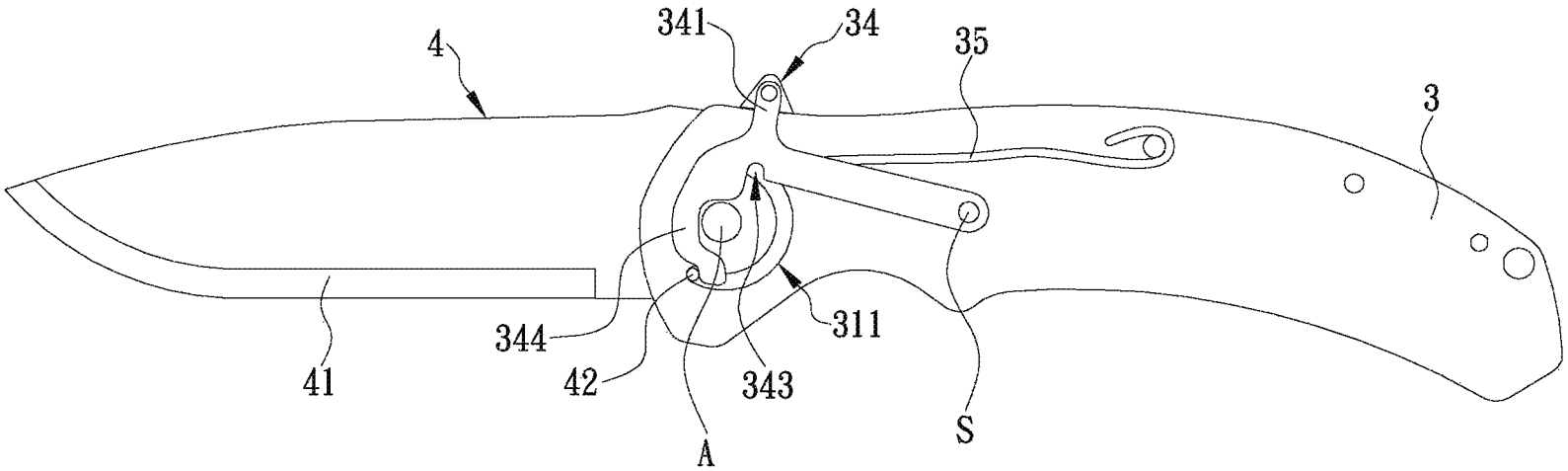
FIG. 5 is a schematic view of the folding knife in an unfolded state, in accordance with the present disclosure.

Please refer back to FIG. 3. The handle 3 includes a pivot pin A disposed adjacent to an end thereof, and an arc-shaped slot 311 formed adjacent to the pivot pin A. In this embodiment, the pivot pin A is disposed on the second outer plate 33 and configured to insert through the middle plate 31 and the first outer plate 30. The arc-shaped slot 311 is formed on the middle plate 31. The blade body 4 includes a blade 41 formed at a side thereof, a blade back 43 formed at the other side thereof, a tip formed at an end thereof, and a pivot hole 40 formed adjacent to other end thereof. The pivot pin A is inserted through the pivot hole 40 to pivotally connect to the handle 3 at a position adjacent to an end of the handle 3. In this embodiment, the blade body 4 is located between the second outer plate 33 and the middle plate 31. The blade body 4 includes a locking pin 42 disposed adjacent to the pivot pin A, configured to insert through the arc-shaped slot 311, and movable along the arc-shaped slot 311. After the blade body 4 is rotated relative to the handle 3, the blade 41 is completely received into a side of the handle 3 and the locking pin 42 is moved and positioned at an end of the arc-shaped slot 311 (as shown in FIG. 4A). After the blade body 4 is rotated to move out of the side of the handle 3, the locking pin 42 is moved and positioned to other end of the arc-shaped slot 311 (as shown in FIG. 5). In order to reliably position the blade body 4 in an unfolded state, the second outer plate 33 further includes a stop plate 333 which has an end extended towards the middle plate 31 and other end fixed between the other end of the second outer plate 33 and the pivot pin A. The stop plate 333 is elastic, and when the blade body 4 is completely unfolded out of the handle 3, the end of the stop plate 333 is pressed against the other end of the blade body 4, in order to stop rotation of the blade body 4 during usage. However, in other embodiment of the present disclosure, manufacturers can apply other structure to position the blade body 4 without being limited to the stop plate 333. It should be noted that the manufacturer can change the structure of the handle 3 by eliminating the middle plate 31, and the arc-shaped slot 311 can be formed on the first outer plate 30, or the arc-shaped slot 311 can also be eliminated.

Please refer back to FIG. 3. The poke member 34 may be assembled on the handle 3 (in this embodiment, the poke member 34 is positioned between the middle plate 31 and the first outer plate 30), and the poke member 34 includes a poke part 341 formed at an end thereof and exposed out of the other side of the handle 3, so that the user can press and apply force on the poke part 341 by finger, to move the poke part 341. The other end of the poke member 34 is pivotally connected between the pivot pin A and the other end of the handle 3 in the handle 3, and the poke member 34 includes a locking groove 343 recessed adjacent to a middle section thereof and facing the pivot pin A. The first elastic component 35 has an end pressed against the poke member 34 adjacent to the middle section of the poke member 34, and other end fixed between the poke member 34 and other end of the handle 3 in the handle 3. The first elastic component 35 is configured to apply a first elastic force on the poke member 34 adjacent to the middle section of the poke member 34, in order to rotate the poke member 34 about its pivoting location to abut with the other side of the handle 3.

Figure 4B:
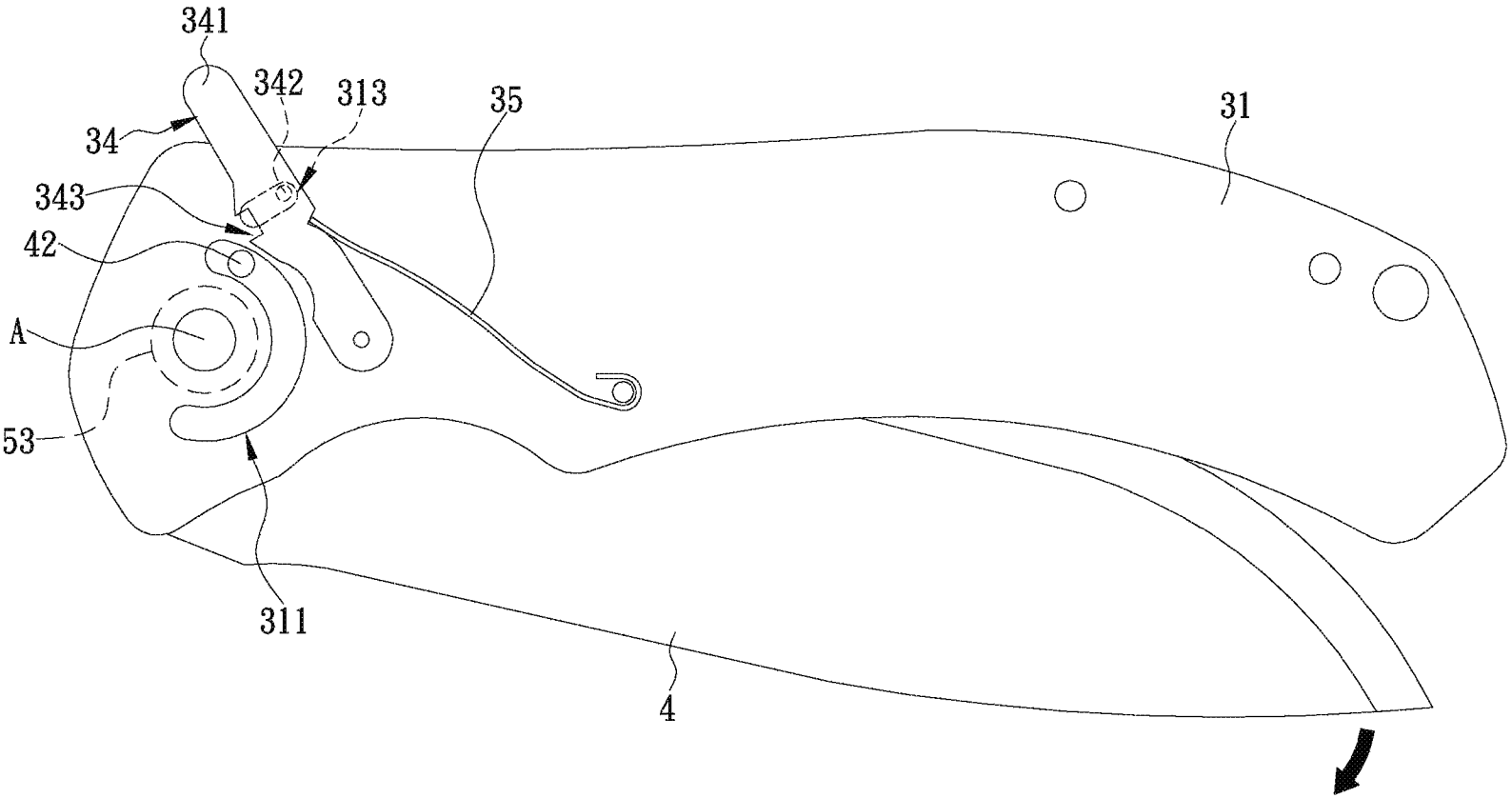
FIG. 4B is a schematic view of a second state of the folding knife of the present disclosure, illustrating that the folding knife is folded.

Please refer to FIGS. 3, 4A and 4B. After the user receives the blade 41 into the side of the handle 3 and the poke part 341 is abutted with the other side of the handle 3, the first elastic component 35 pushes the poke member 34, so that the locking pin 42 is engaged into the locking groove 343 (as shown in FIG. 4A). At this time, the locking pin 42 is non-movable because of being blocked by the locking groove 343, and the blade body 4 is at a locked state in which the blade body 4 is non-rotatable relative to the handle 3. Therefore, while carrying the folding knife, the user does not worry to be damaged by the blade body 4 which is abruptly released from the handle 3 if the folding knife is collided accidently. The folding knife of the present disclosure has improved safety in carry. In order to use the folding knife, the user can poke the poke part 341 by finger, so that the poke part 341 is moved towards the other end of the handle 3 and, at this time, the locking groove 343 is separated from the locking pin 42 and does not block the locking pin 42 any more (as shown in FIG. 4B). As a result, the blade body 4 becomes rotatable relative to the handle 3, and it is convenient for the user to rotate the blade body 4 for completely unfolding the blade 41 out of the handle 3.

Please refer back to FIG. 3. In order to facilitate the user to rotate the blade body 4 out of the handle 3, the blade body 4 includes a locating groove 44 recessed adjacent to the pivot pin A and facing the blade 41. The poke member 34 includes a locating pin 342 formed adjacent to a middle section thereof. When the poke member 34 is assembled with the handle 3, the locating pin 342 is inserted through a guide slot 313 of the middle plate 31 and movable along the guide slot 313. When the blade 41 is received in the side of the handle 3, the locating pin 342 is engaged into the locating groove 44. When the user wants to use the folding knife and poke the poke part 341 towards the other end of the handle 3, the locating pin 342 can be separated from the locating groove 44 and, at this time, the locating pin 342 also pushes against an inner edge of the locating groove 44 to slightly move a part of the blade body 4 towards the outside of the handle 3, as shown by an arrow at the tip in the FIG. 4B. As a result, compared with FIG. 4A, the blade body 4 of FIG. 4B is more exposed out of the handle 3, so that the user can pull and rotate the blade body 4 more easily.

In order to automatically eject the blade body of the folding knife of the present disclosure, like the conventional folding knife, the handle 3 further includes a second elastic component 53. Please refer to FIG. 3. In this embodiment, the second elastic component 53 is disposed between the pivot pin A and the blade body 4 and configured to apply a force on the blade body 4 to rotate out of the handle 3. Preferably, the second elastic component 53 can be a volute spring. The handle 3 further includes a constraining unit 55 which includes a push spring 551, a fastening member 553 (such as a steel ball) and a sleeve 555. In this embodiment, the constraining unit 55 is received in a recess 331 of the second outer plate 33. The fastening member 553 and the push spring 551 are assembled in the sleeve 555, and an end of the push spring 551 is abutted against a bottom surface of the recess 331 of the second outer plate 33, and other end of the push spring 551 is abutted against a bottom of the fastening member 553, so that a top of the fastening member 553 protrudes out of a top of the sleeve 555. When the blade body 4 is completely received in the handle 3, an engagement hole 45 of the blade body 4 corresponds in position to the constraining unit 55, so that the fastening member 553 exposing out of the top of the sleeve 555 can be abutted with a side wall of the engagement hole 45. The push spring 551 applies the fastening member 553 by the force higher than the force by which the second elastic component 53 applies on the blade body 4 to rotate outwardly, so as to position the blade body 4 in the handle 3 and block the blade body 4 from rotating out of the handle 3. It should be noted that, in other embodiment of the present disclosure, the manufacturer can apply other structure to position the blade body 4 without being limited by the aforesaid structure of the constraining unit 55. In other embodiment, the second elastic component can be a conventional elastic sheet, such as the elastic sheet 15 shown in FIG. 1A, as the auxiliary tool for pushing the blade body 4. When the locking pin 42 is located at the end of the arc-shaped slot 311, the second elastic component (such as, in the form of the elastic sheet) can apply force on the handle 3 to rotate. When the user rotates the blade body 4 out of the handle 3 by a predetermined angle (about 4 to 8 degrees), the second elastic component applies the second elastic force on the blade body 4 to then automatically eject and unfold the blade body 4 and the blade 41 out of the handle 3. The way of using aforesaid elastic sheet is a known technology, and the main feature of the present disclosure is the structure of the folding knife with the locking function, so the detailed description of the elastic sheet is not repeated;

however, one skilled in the art is able to apply the structure of the present disclosure to various folding knives having similar structures after understanding the entire technical features of the present disclosure.

Please refer to FIG. 5. In other embodiment of the present disclosure, the poke member 34 includes a locking arm 344 located between the poke part 341 and the locking groove 343 and protruded towards the pivot pin A. When the blade 41 is unfolded out of the side of the handle 3, a free end of the locking arm 344 is engaged with the locking pin 42, so that the blade body 4 is stopped from rotating relative to the handle 3, that is, the folding knife is in the locked state, as shown in FIG. 5. In order to fold the folding knife, the user can poke the poke part 341 by finger, so that the poke part 341 moves towards the other end of the handle 3 and, at this time, the free end of the locking arm 344 is slid along an outer edge of the locking pin 42 because of being stopped by the locking pin 42. As a result, the poke member 34 is rotated about its pivoting location (such as the symbol S shown in FIG. 5), and the free end of the locking arm 344 can be separated from the locking pin 42, so that the blade body 4 is rotatable relative to the handle 3, that is, the folding knife is in a released state. When the locking arm 344 is engaged, the blade body 4 can be positioned at the outside of the handle 3. It should be noted that, under a condition that the free end of the locking arm 344 is engaged with the locking pin 42 and the blade body 4 is applied by force, the user does not need to worry about abrupt rotation of the blade body 4 apart from current position during usage of the folding knife because the locking pin 42 pushes the free end of the locking arm 344 in a direction which is not outward rotation direction of the locking arm 344 along the poke member 34 (that is, not the direction in which the free end of the locking arm 344 is separated from the locking pin 42). The folding knife with this feature can have greatly improved convenience in use.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A folding knife with a locking function, comprising:

a handle;

a blade body, comprising a blade at a side thereof, a blade back at other side thereof and a tip at an end thereof, wherein a part of the blade body adjacent to other end of the blade body is pivotally connected to a part of the handle adjacent to an end of the handle through a pivot pin, and the blade body comprises a locking pin protruded at a part thereof adjacent to the pivot pin, and wherein the blade body is rotatable relative to the handle, thereby being unfolded out of the handle or received into a side of the handle;

a poke member, comprising a poke part formed at an end thereof and exposed out of other side of the handle, and other end of the poke member pivotally connected between the pivot pin and other end of the handle in the handle, and wherein the poke member comprises a locking groove recessed adjacent to a middle section thereof and facing the pivot pin, and under a condition that the blade is received into the side of the handle, the locking pin is engaged into the locking groove to make the blade body in a locked state where the blade body is stopped from rotating relative to the handle, and wherein when the poke part is poked towards the other end of the handle, the locking pin is separated from the locking groove and the blade body enters a released state where the blade body is rotatable relative to the handle; and a first elastic component, comprising an end abutted with the poke member adjacent to the middle section of the poke member, and other end fixed between the poke member and the other end of the handle in the handle, and configured to apply a first elastic force to a part of the poke member adjacent to the middle section of the poke member, to abut the poke part with the other side of the handle.

2. The folding knife according to claim 1, further comprising a second elastic component mounted between the handle and the blade body and configured to apply a second elastic force on the blade body to rotate out of the handle.

3. The folding knife according to claim 2, wherein the second elastic component is a volute spring mounted on the pivot pin.

4. The folding knife according to claim 3, wherein the blade body comprises an engagement hole, and the handle comprises a constraining unit which comprises:

a sleeve, positioned in a recess of the handle;

a push spring, positioned in the sleeve and comprising an end abutted with a bottom surface of the recess; and a fastening member, positioned in the sleeve and abutted with the other end of the push spring by a bottom thereof, and a top of the fastening member protruded out of a top of the sleeve, and under a condition that the blade is received into the side of the handle, the engagement hole corresponds in position to the constraining unit, so that the top of the fastening member is abutted with a side wall of the engagement hole and the push spring applies to the fastening member a force higher than the second elastic force by which the second elastic component applies to the blade body to rotate out of the handle.

5. The folding knife according to claim 2, wherein the second elastic component is an elastic sheet which comprises an end disposed adjacent to the pivot pin and abutted with the other end of the blade body, and other end extended towards the other end of the handle, and when the blade body is rotated out of the handle by a predetermined angle, the second elastic component applies the second elastic force on the blade body, to automatically eject and unfold the blade body and the blade out of the handle.

6. The folding knife according to claim 1, wherein the blade body comprises a locating groove recessed adjacent to the pivot pin and facing the blade, and the poke member comprises a locating pin disposed adjacent to a middle section thereof, and the locating pin is engaged into the locating groove when the blade is received into the side of the handle, and the locating pin is separated from the locating groove when the poke part is poked towards the other end of the handle.

7. The folding knife according to claim 2, wherein the blade body comprises a locating groove recessed adjacent to the pivot pin and facing the blade, and the poke member comprises a locating pin disposed adjacent to a middle section thereof, and the locating pin is engaged into the locating groove when the blade is received into the side of the handle, and the locating pin is separated from the locating groove when the poke part is poked towards the other end of the handle.

8. The folding knife according to claim 3, wherein the blade body comprises a locating groove recessed adjacent to the pivot pin and facing the blade, and the poke member comprises a locating pin disposed adjacent to a middle section thereof, and the locating pin is engaged into the locating groove when the blade is received into the side of the handle, and the locating pin is separated from the locating groove when the poke part is poked towards the other end of the handle.

9. The folding knife according to claim 4, wherein the blade body comprises a locating groove recessed adjacent to the pivot pin and facing the blade, and the poke member comprises a locating pin disposed adjacent to a middle section thereof, and the locating pin is engaged into the locating groove when the blade is received into the side of the handle, and the locating pin is separated from the locating groove when the poke part is poked towards the other end of the handle.

10. The folding knife according to claim 5, wherein the blade body comprises a locating groove recessed adjacent to the pivot pin and facing the blade, and the poke member comprises a locating pin disposed adjacent to a middle section thereof, and the locating pin is engaged into the locating groove when the blade is received into the side of the handle, and the locating pin is separated from the locating groove when the poke part is poked towards the other end of the handle.

11. The folding knife according to claim 6, wherein the poke member comprises a locking arm protruded between the poke part and the locking groove and towards the pivot pin, and a free end of the locking arm is engaged into the locking pin when the blade is unfolded out of the side of the handle, so that the blade body is in the locked state and unable to rotate relative to the handle; wherein the free end of the locking arm is separated from the locking pin when the poke part is poked towards the other end of the handle, so that the blade body is in the released state and rotatable relative to the handle.

12. The folding knife according to claim 7, wherein the poke member comprises a locking arm protruded between the poke part and the locking groove and towards the pivot pin, and a free end of the locking arm is engaged into the locking pin when the blade is unfolded out of the side of the handle, so that the blade body is in the locked state and unable to rotate relative to the handle; wherein the free end of the locking arm is separated from the locking pin when the poke part is poked towards the other end of the handle, so that the blade body is in the released state and rotatable relative to the handle.

13. The folding knife according to claim 8, wherein the poke member comprises a locking arm protruded between the poke part and the locking groove and towards the pivot pin, and a free end of the locking arm is engaged into the locking pin when the blade is unfolded out of the side of the handle, so that the blade body is in the locked state and unable to rotate relative to the handle; wherein the free end of the locking arm is separated from the locking pin when the poke part is poked towards the other end of the handle, so that the blade body is in the released state and rotatable relative to the handle.

14. The folding knife according to claim 9, wherein the poke member comprises a locking arm protruded between the poke part and the locking groove and towards the pivot pin, and a free end of the locking arm is engaged into the locking pin when the blade is unfolded out of the side of the handle, so that the blade body is in the locked state and unable to rotate relative to the handle; wherein the free end of the locking arm is separated from the locking pin when the poke part is poked towards the other end of the handle, so that the blade body is in the released state and rotatable relative to the handle.

15. The folding knife according to claim 10, wherein the poke member comprises a locking arm protruded between the poke part and the locking groove and towards the pivot pin, and a free end of the locking arm is engaged into the locking pin when the blade is unfolded out of the side of the handle, so that the blade body is in the locked state and unable to rotate relative to the handle; wherein the free end of the locking arm is separated from the locking pin when the poke part is poked towards the other end of the handle, so that the blade body is in the released state and rotatable relative to the handle.

16. The folding knife according to claim 11, wherein the handle comprises an arc-shaped slot adjacent to the pivot pin, and the locking pin is inserted through the arc-shaped slot and movable along the arc-shaped slot; wherein when the blade is received into the side of the handle, the locking pin is located at an end of the arc-shaped slot, and the locking pin is located at other end of the arc-shaped slot when the blade is completely unfolded out of the handle.

17. The folding knife according to claim 12, wherein the handle comprises an arc-shaped slot adjacent to the pivot pin, and the locking pin is inserted through the arc-shaped slot and movable along the arc-shaped slot; wherein when the blade is received into the side of the handle, the locking pin is located at an end of the arc-shaped slot, and the locking pin is located at other end of the arc-shaped slot when the blade is completely unfolded out of the handle.

18. The folding knife according to claim 13, wherein the handle comprises an arc-shaped slot adjacent to the pivot pin, and the locking pin is inserted through the arc-shaped slot and movable along the arc-shaped slot; wherein when the blade is received into the side of the handle, the locking pin is located at an end of the arc-shaped slot, and the locking pin is located at other end of the arc-shaped slot when the blade is completely unfolded out of the handle.

19. The folding knife according to claim 14, wherein the handle comprises an arc-shaped slot adjacent to the pivot pin, and the locking pin is inserted through the arc-shaped slot and movable along the arc-shaped slot; wherein when the blade is received into the side of the handle, the locking pin is located at an end of the arc-shaped slot, and the locking pin is located at other end of the arc-shaped slot when the blade is completely unfolded out of the handle.

20. The folding knife according to claim 15, wherein the handle comprises an arc-shaped slot adjacent to the pivot pin, and the locking pin is inserted through the arc-shaped slot and movable along the arc-shaped slot; wherein when the blade is received into the side of the handle, the locking pin is located at an end of the arc-shaped slot, and the locking pin is located at other end of the arc-shaped slot when the blade is completely unfolded out of the handle.

* * * * *